US007070169B2

(12) United States Patent
Hernandez, Jr.

(10) Patent No.: US 7,070,169 B2
(45) Date of Patent: Jul. 4, 2006

(54) CABLE PULLER WITH UNIQUE GRIP AND METHOD

(75) Inventor: Hector R. Hernandez, Jr., Fullerton, CA (US)

(73) Assignee: Alltrade Tools LLC

( * ) Notice: Subject to any disclaimer, the term of this patent is extended or adjusted under 35 U.S.C. 154(b) by 116 days.

(21) Appl. No.: 10/376,996

(22) Filed: Feb. 28, 2003

(65) Prior Publication Data

US 2004/0169170 A1 Sep. 2, 2004

(51) Int. Cl.
*B21F 9/00* (2006.01)

(52) U.S. Cl. ..... 254/243; 81/177.1; 16/110.1; 16/421; 16/430; 74/545; D8/303

(58) Field of Classification Search ..... 254/243, 254/248; 81/177.1, 489, 436–440; 16/110.1, 16/421, 422, 430; D8/82–87, 21–29, 107, D8/303, 44; 74/545
See application file for complete search history.

(56) References Cited

U.S. PATENT DOCUMENTS 1,357,848 A * 11/1920 Coes ..... 81/177.1
2,666,340 A * 1/1954 Hunt ..... 74/551.9
4,934,024 A * 6/1990 Sexton, I ..... 16/421
5,440,784 A * 8/1995 Hull et al. ..... 16/430
5,584,096 A * 12/1996 Aurora ..... 16/421
5,588,343 A * 12/1996 Rust et al. ..... 81/489
D403,943 S * 1/1999 Curry ..... D8/107
D424,903 S * 5/2000 Hreha et al. ..... D8/80
D429,990 S * 8/2000 Kunkler ..... D8/303
D432,381 S * 10/2000 Khachatoorian ..... D8/80
6,148,483 A * 11/2000 DeGraff ..... 16/430
D436,828 S * 1/2001 Benktzon et al. ..... D8/107
6,174,244 B1 * 1/2001 Zimmerman ..... 473/203
6,247,385 B1 * 6/2001 Wu ..... 81/177.1
D453,465 S * 2/2002 Hsieh ..... D8/107
D462,003 S * 8/2002 Juhlin ..... D8/107
D465,716 S * 11/2002 Hsieh ..... D8/107
D466,390 S * 12/2002 Hung ..... D8/107
6,513,198 B1 * 2/2003 Lu ..... 16/431
D476,535 S * 7/2003 Garon ..... D7/649
D481,291 S * 10/2003 Hernandez, Jr. ..... D8/107
D490,680 S * 6/2004 Levine et al. ..... D8/83
D498,130 S * 11/2004 Tomchak et al. ..... D8/107

* cited by examiner

*Primary Examiner*—Emmanuel M Marcelo
(74) *Attorney, Agent, or Firm*—John J. Connors; Connors & Assoc. Inc.

(57) ABSTRACT

A cable puller has on its actuating lever an elongated grip with an ergonomically friendly shape that directs a user to use both hands placed side by side on the grip when manipulating the lever.

39 Claims, 6 Drawing Sheets

12
46
62a
62b
28
44
26
LH
RH
2A
2A
48
62b
62a
46
12
20b
20
18
14
14a
14b
14c
16a
16b
16c
16c
16d
W1
22
23
23b
23b 36
32c
32a
12
32
N
42
32b
38
32d
24b
24a
26
28
27
40
25
30c
34
30a
24
B
30
20
30b
30d

CABLE PULLER WITH UNIQUE GRIP AND METHOD

DEFINITIONS

The words "comprising," "having," and "including," and other forms thereof, are intended to be equivalent in meaning and be open ended in that an item or items following any one of these words is not meant to be an exhaustive listing of such item or items, or meant to be limited to only the listed item or items.

Cable shall mean a length of flexible material made of a single strand or a plurality of strands.

BACKGROUND OF INVENTION

A cable puller may be used for hoisting, hauling, or both. Cable pullers typically comprise an unwinched hook, a winched hook, a ratchet device, and a cable having one end connected to the ratchet device and another end attached to the winched hook. A cable puller is used by attaching the unwinched hook to an anchor and the winched hook to a load. The ratchet device is then manually actuated so as to winch the cable by rotating an actuating lever of the cable puller. A user typically uses one hand to hold the actuating lever, placing his or her one hand at a distal end of a grip coupled to the actuating lever, or uses two hands, placing one hand over the other at the distal end of the grip.

SUMMARY OF INVENTION

This invention, with its several desirable features, is summarized in the CLAIMS that follow. After reading the following section entitled "DETAILED DESCRIPTION," one will understand how the features of this invention provide its benefits. These benefits include, but are not limited to: providing a cable puller grip that facilitates using two hands placed side by side to rotate the actuating lever, thereby spreading the force over the length of the lever rather than at its distal end.

Some, but not all, of the features of this invention are:

One, the grip of this invention is adapted to be coupled to a manually actuated lever of a cable puller to assist a user to hold the lever with two hands positioned side by side. The grip may be coupled to the actuating lever by inserting a distal end of the actuating lever through an open proximal end into an interior of the grip's body. If desired, the grip may be removed and replaced. In one embodiment, the grip includes a unitary, elongated body having a hollow interior extending lengthwise. In another embodiment, the grip comprises a pair of hollow bodies mounted on the actuating lever of the cable puller side by side, either abutting each other or spaced apart. Typically, the grip has a length greater than about 12 inches and a cross-sectional area from about 1.5 to about 3 square inches. In the embodiment employing a pair of bodies, each body has a length from about 4 inches to about 8 inches.

Two, the grip may include a first longitudinal side and a second longitudinal side opposite the first longitudinal side. A palm section may extend lengthwise substantially along the entire length of the first longitudinal side, and a finger section may extend lengthwise substantially along the entire length of the second longitudinal side. The finger section may have a first arcuate segment bowing away from the palm section and a second arcuate segment bowing towards the palm section. Typically, the first arcuate segment has a length from about 4 inches to about 8 inches and the second arcuate segment has a length from about 4 inches to about 8 inches. The first arcuate segment may be inboard of the second arcuate segment. A raised, rounded intermediate segment may be between the first and second arcuate segments. Typically, the intermediate segment is not present in the embodiment where the grip comprises two separate bodies. In either embodiment, the arcuate segments are aligned along the length of the lever facing away from the user.

Three, the palm section may comprise an exterior, substantially planar surface. It may have a plurality of laterally orientated grooves positioned side by side, substantially parallel to each other, and its exterior has rounded lateral edges so that it is curved laterally generally to the shape of a partially closed palm of a human hand. The finger section comprises a plurality of indented contoured portions shaped to the outline of portions of individual fingers from human hands and positioned in a row side by side to orient the hands of a user in a side by side relationship when grasping the grip. In one embodiment, the finger section includes eight opposed pairs of contoured portions in two groups of four, one group of four on each arcuate segment.

Four, the body or bodies of the grip may be made of a molded polymeric material with a pair of lengthwise extending recesses therein on opposite sides of the body or bodies. One recess is configured to receive the palm section and the other recess is configured to receive the finger section. Typically, each section is made of a substantially non-slippery material such as a thermoplastic rubber applied to the recesses. These sections may be bonded to the body by an adhesive or by molding, for example by insert molding, or by stamping.

Five, the cross-sectional shape of the grip may vary. For example, it may be substantially quadrilateral, such as trapezoidal, circular, oval, or oblong. The trapezoidal shape includes opposed sides that may taper into the finger section. A trapezoidal shaped grip is ergonomically desirable because it is comfortable to hold when applying a pulling force to the actuating lever of the cable puller. In this embodiment, the body includes a pair of sidewalls connecting a top wall to a bottom wall. Longitudinal junctions may be formed along the edges where the walls meet the palm section and finger section. The palm and finger sections may each include overlapping segments covering adjacent portions of the sidewalls. The sidewalls may taper inward towards the finger section.

These features are not listed in any rank order nor is this list intended to be exhaustive.

This invention also includes a cable puller using the grip of this invention and a method of moving a load employing this cable puller. By grasping the grip with both hands in a side by side relationship, the user distributes the pulling force over the length of the actuating lever rather than just at its distal end. Also, the user has the ability to control more easily the orientation of the cable puller, enabling the user to twist the lever and cable puller to one side or the other as he or she is manipulating the lever.

DESCRIPTION OF DRAWING

The preferred embodiments of this invention, illustrating all its features, will now be discussed in detail. These embodiments depict the novel and non-obvious cable puller and method of this invention as shown in the accompanying drawing, which is for illustrative purposes only. This drawing includes the following figures (FIGS.), with like numerals indicating like parts.

DETAILED DESCRIPTION OF SOME EMBODIMENTS OF THIS INVENTION

Figure 1:
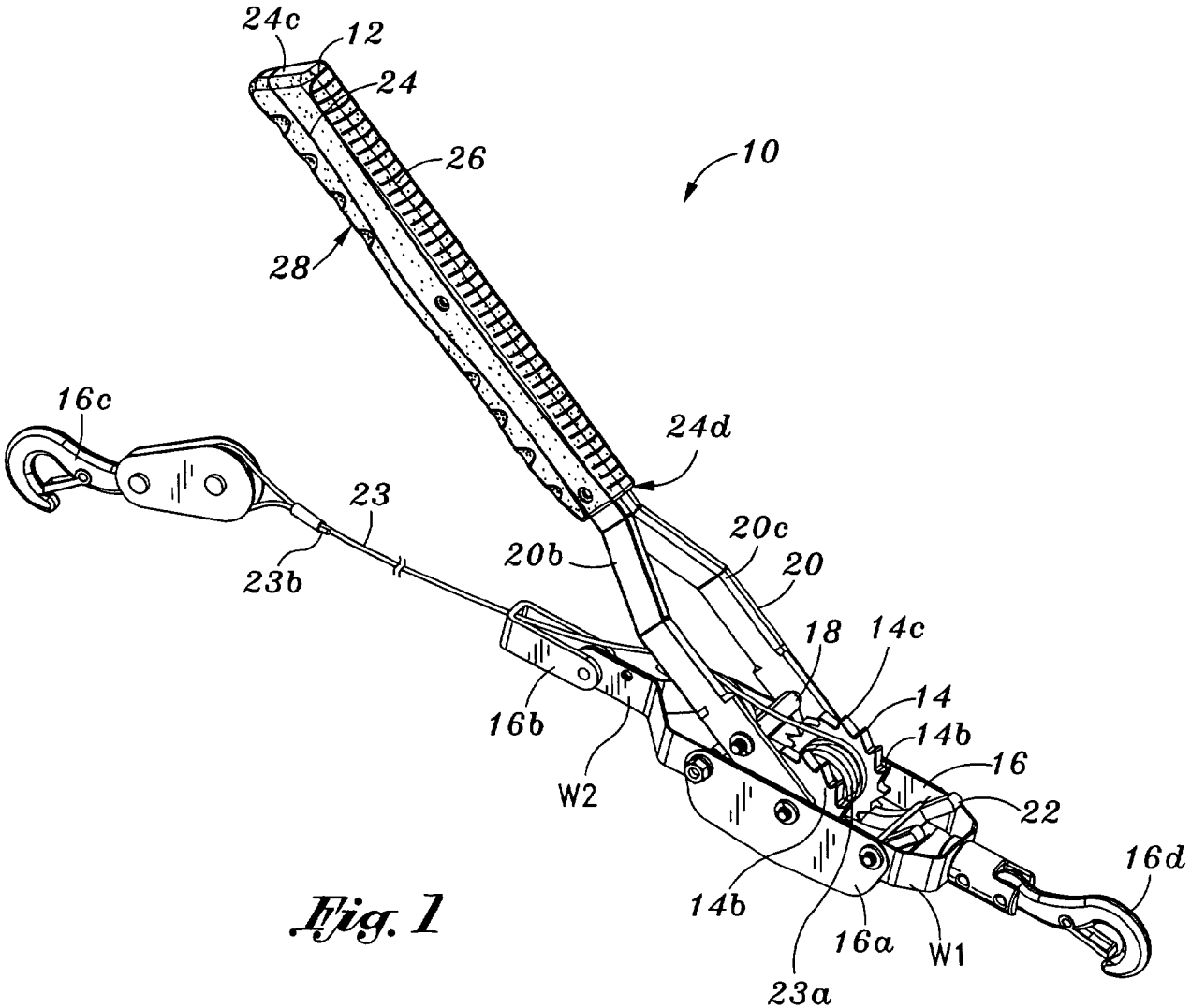
FIG. 1 is a perspective view of a cable puller according to one embodiment of the invention.
Figures 2, 2A:
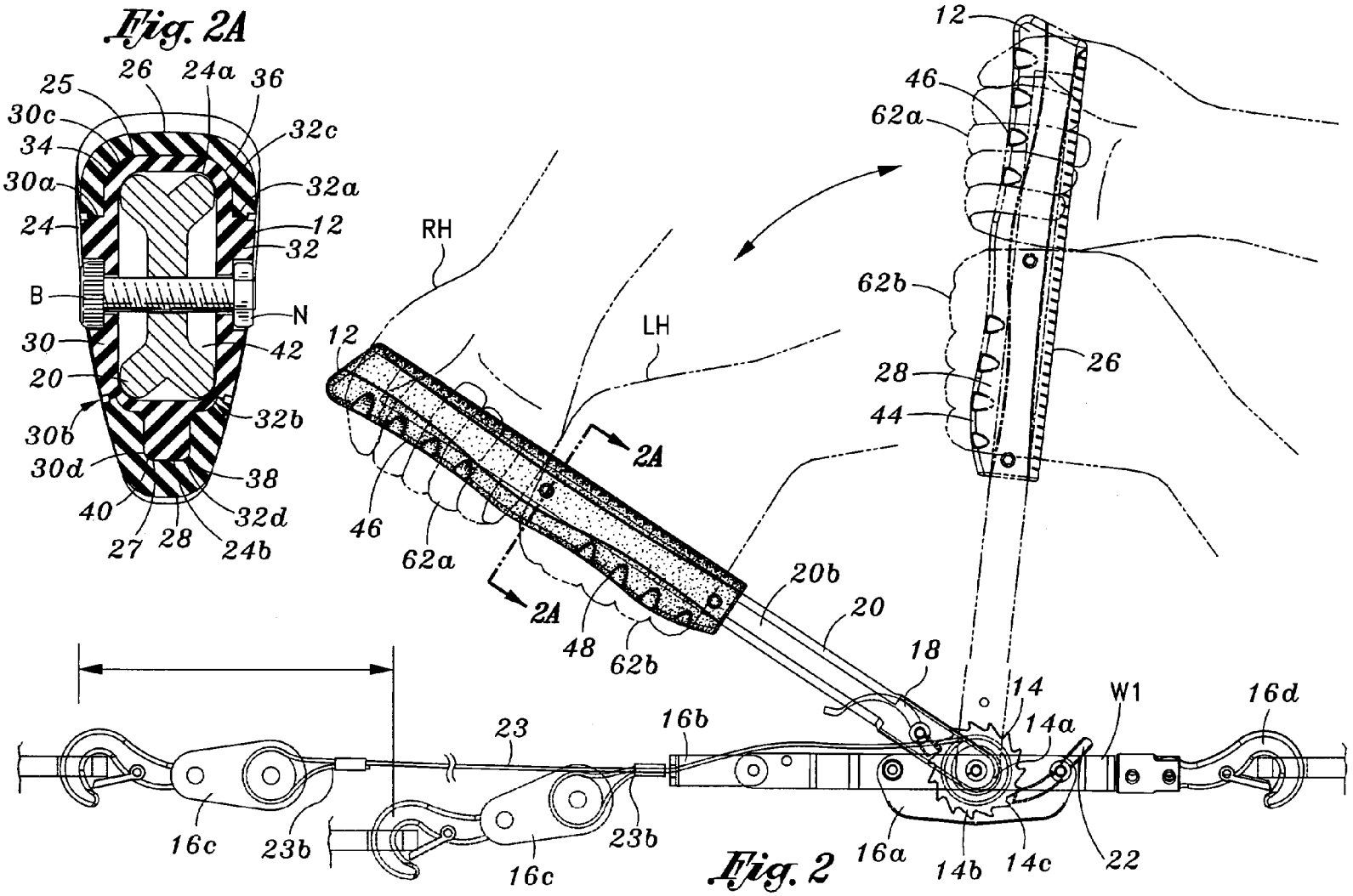
FIG. 2 is a side view of a cable puller shown in FIG. 1 illustrating movement of the actuating lever and the cable puller.
FIG. 2A is cross-sectional view taken along line 2A—2A in FIG. 2.
Figure 12:
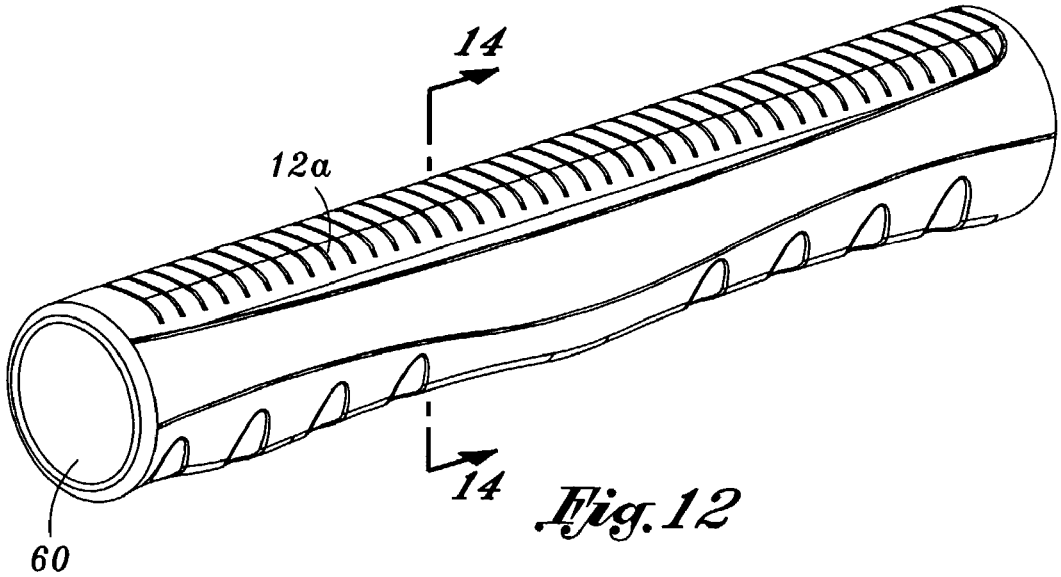
FIG. 12 is a perspective view of a cable puller grip having a circular cross-section.
Figure 14:
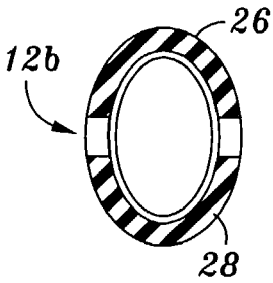
FIG. 14 is a cross-sectional view of a cable puller grip having an oval configuration.
Figure 15:
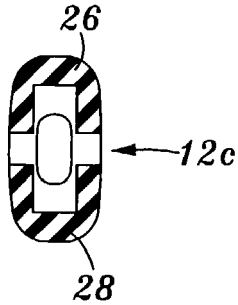
FIG. 15 is a cross-sectional view of a cable puller grip having an oblong configuration.

Referring to FIGS. 1 and 2, the cable puller 10 comprises a drum 14, a frame 16, a feed pawl 18, a retainer pawl 22, a cable 23, and an actuating lever 20 including a grip 12 mounted on the actuating lever 20. A novel feature of this invention is the grip 12, which has a length from about 12 inches to about 18 inches. The length of the grip 12 facilitates holding it with two hands 62*a* and 62*b* placed side by side in accordance with one feature of this invention. The grip 12 has a unique ergonomically friendly shape that directs the user to place his or her hands side by side on the grip to more evenly distribute the pulling forces over the length of the actuating lever 20, rather than applying the pulling force at the distal end 20*a* (FIG. 3) of the actuating lever 20 as heretofore. As shown in FIG. 2A, in one embodiment, the grip 12 has a substantially quadrilateral cross-sectional shape, for example, its cross-sectional shape is substantially trapezoidal. In other embodiments, the grip may have other cross-sectional shapes. For example, one embodiment, the grip 12*a*, has a substantially circular cross-sectional shape as shown in FIG. 12. Another embodiment, the grip 12*b*, has a substantially oval cross-sectional shape as shown in FIG. 14. Still another embodiment, the grip 12*c*, has a substantially oblong cross-sectional shape as shown in FIG. 15. Typically, the grip has a cross-sectional area from about 1.5 to about 3 square inches.

As best shown in FIGS. 4 through 11, the grip 12 comprises an elongated body 24 including a palm section 26 and a finger section 28 opposed to the palm section. This body 24 may be formed from a polymeric material such as, for example, polypropylene. The palm section 26 and the finger section 28 are typically made from a substantially non-slippery material. The substantially non-slippery material may comprise a moldable rubber material, such as thermoplastic rubber. The palm section 26 and the finger section 28 may be bonded to the exterior of the body 24 by molding, such as by forming the body 24 first by injection molding in a first mold, and then placing the body 24 into a second mold and injecting molten rubber material into the second mold to form on the body the palm section 26 and finger section 28. Alternatively, the finger section 26, or palm section 28,or both, may be molded first, and then one or both of these sections may then be placed into a second mold, and the body 24 material injected into the second mold. The palm section 26 and the finger section 28 may also be bonded to the body 24 by stamping or using an adhesive.

Figure 5:
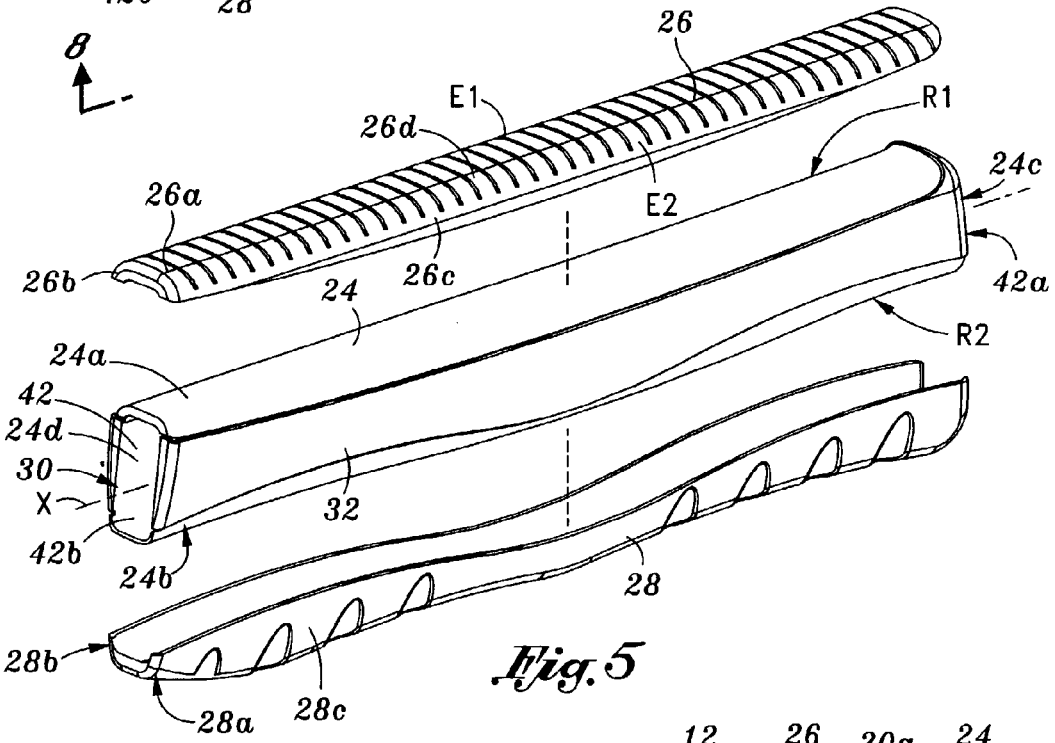
FIG. 5 is an exploded view of the grip shown in FIG. 4.
Figure 6:
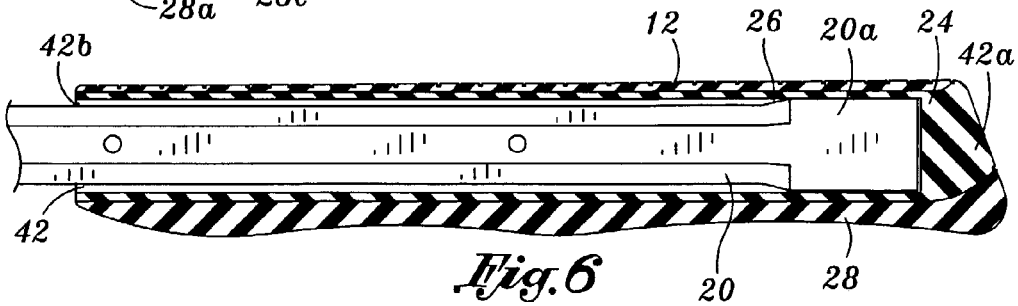
FIG. 6 is a cross-sectional view taken along line 6—6 of FIG. 4 with the actuating lever partially (or completely) inserted into the grip.
Figure 7:
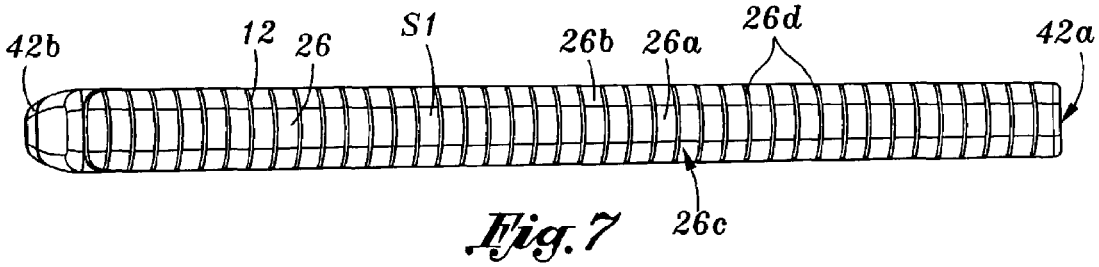
FIG. 7 is a top view of the grip taken along line 7—7 of FIG. 4.
Figure 8:
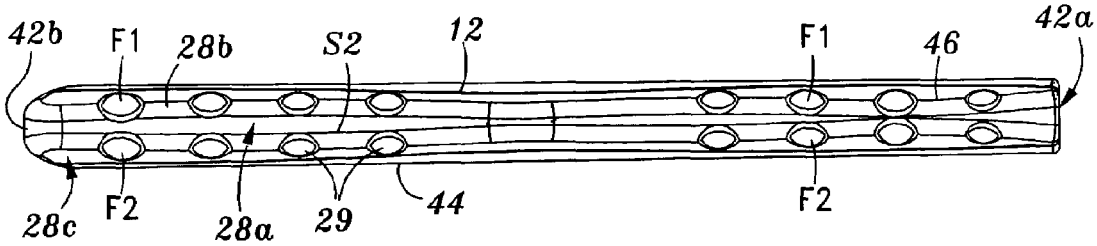
FIG. 8 is a bottom view of the grip taken along line 8—8 of FIG. 4.
Figure 9:
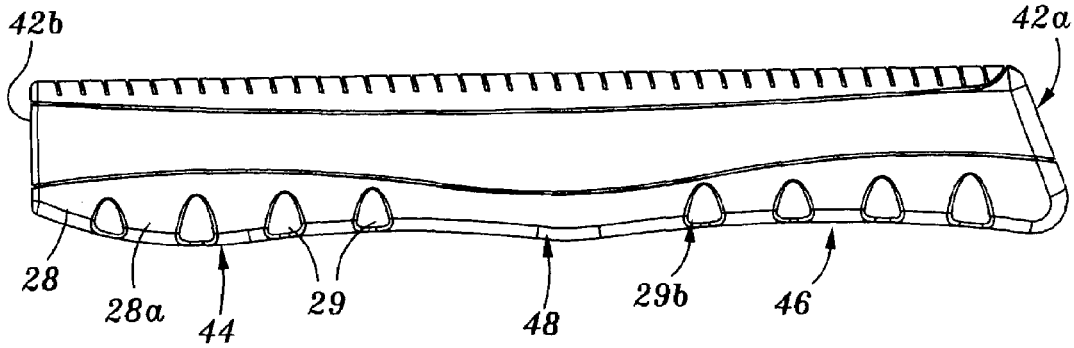
FIG. 9 is a side view of the grip shown in FIG. 4.
Figure 10:
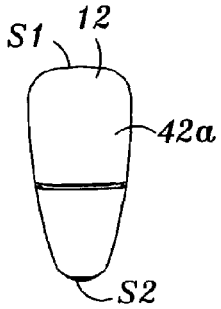
FIG. 10 is an end view of the grip taken along line 10—10 of FIG. 3.
Figure 11:
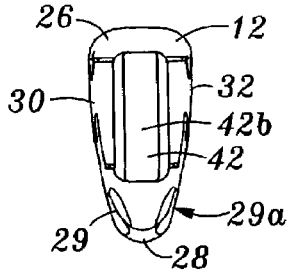
FIG. 11 is an end view of the grip taken along line 11—11 of FIG. 3.

As best shown in FIGS. 5 and 6, the body 24 may have a hollow interior 42 with a closed end 42*a* (FIG. 10) and an open end 42*b* (FIG. 11). The closed end 42*a* is located on the distal end 24*c* of the body 24, and the open end 42*b* is located on the proximal end 24*d* of the body 24. The hollow interior 42 may extend along the length of the body 24. The grip 12 is mounted to the actuating lever 20 by inserting the distal end 20*a* of actuating lever 20 into the open end 42*b* of the body 24 and passing one or more bolts B through both the grip 12 and the actuating lever 20 and fastening in position with nuts or rivets N (FIG. 2A).

As the embodiment depicted in FIGS. 2A and 5 illustrates, the body 24 may comprise a top wall 24*a*, a bottom wall 24*b*, and a pair of opposed sidewalls 30 and 32. Each sidewall 30, 32 may have, respectively, a pair of individual steps 30*a*, 30*b* and 32*a*, 32*b*. The steps 30*a*, 32*a* each lie proximate to the top wall 24*a* and form therein an elongated recess R1 configured to receive the palm section 26. The steps 30*b*, 32*b* lie proximate to the bottom wall 24*b* and form therein an elongated recess R2 configured to receive the finger section 28. Upper rounded edges 30*c* and 32*c*, respectively of sidewalls 30, 32, are connected to, and integral with, the top wall 24*a* to form a pair of junctions 34 and 36. Lower edges 30*d* and 32*d*, respectively of sidewalls 30, 32 are connected to, and integral with, the bottom wall 24*b* to form a pair of junctions 38 and 40. The sidewalls 30, 32 taper inward towards the finger section 28.

In the embodiment shown in FIGS. 5 and 6, the palm section 26 extends lengthwise substantially along the entire length of top wall 24*a* of the body 24. It may have rounded lateral edges E1 and E2. As depicted in FIG. 2A, the palm section 26 fits into the recess R1 and has an underside 25 that overlaps the junctions 34 and 36, such that upper portions of the sidewalls 30, 32 are covered. The palm section 26 comprises a segment 26*a*, a segment 26*b* and a segment 26*c*. The segment 26*a* covers essentially the entire the top wall 24*a* of the body 24, the segment 26*b* covers an upper portion of the sidewall 30, and the segment 26*c* covers an upper portion of the sidewall 32. The segment 26*a* has an exterior, substantially planar top surface S1. This segment 26*a* may have a plurality of laterally orientated grooves 26*d* positioned side-by-side and substantially parallel to each other and at a right angle to the axis X of the body 24. The grooves 26*d* may extend from the segment 26*b*, through the segment 26*a*, and through the segment 26*c*.

As shown in FIGS. 2A and 5, the finger section 28 extends lengthwise substantially along the entire length of the bottom wall 24*b* and fits into the recess R2. It has an underside 27 that overlaps the junctions 38 and 40, such that lower portions of the sidewalls 30, 32 are covered. The finger section 28 comprises a segment 28*a*, a segment 28*b*, and a segment 28*c*. The segment 28*a* covers essentially the entire the bottom wall 24*b*, the segment 28*b* covers a lower portion of the sidewall 30, and the segment 28*c* covers a lower portion of the sidewall 32. The segment 28*a* has an exterior, undulating bottom surface S2 that is narrower than the top surface S1 of the segment 26*a* of the palm section 26. Consequently, as shown in FIG. 2A, the cross-sectional shape of the grip 12 of this one embodiment is substantially trapezoidal having a rounded bottom surface S2 that fits comfortably into the partially closed fingers of a user grasping the grip 12.

As best illustrated in FIGS. 7 through 9, and 11, the finger section 28 has an arcuate segment 44 bowing away from the palm section 26 and an arcuate segment 46 bowing towards the palm section 26. The arcuate segment 44 typically has a length from about 4 to about 8 inches and the arcuate segment 46 has a length from about 4 to about 8 inches. The arcuate segment 44 preferably is inboard of the arcuate segment 46 when the grip 12 is placed on the actuating lever 20. A raised, rounded intermediate segment 48 may lie between the arcuate segment 44 and arcuate segment 46. The grip 12 is mounted on the actuating lever 20 so the arcuate segment 44 and 46 face away from the user when he or she is manipulating the lever 20.

A plurality of contoured indented portions 29 serving as finger guides are disposed along the length of the finger section 28. They are shaped to the outline of central portions of individual fingers from a pair of human hands and assist in directing a user to employ both hands 62*a*, 62*b* as illustrated in FIG. 2. The contoured portions 29 are positioned in a row, side by side, such that when a user places his or her fingers onto the contoured portions 29, his or her hands 62*a*, 62*b* are oriented in a side-by-side relationship when grasping the grip 12. As shown best in FIG. 8, the indented portions 29 are grouped into eight opposing pairs F1 and F2. These eight opposing pairs F1 and F2 correspond to the number of fingers of both hands 62*a*, 62*b* of a user wrapped around the grip 12. The indented portions 29 identified as F1 are molded into the surface of the segment 28*b* of the finger section 28, and the indented portions 29 identified as F2 are molded into the surface of the segment 28*c* of the finger section. As shown in FIG. 2, a right-handed user would normally place his or her right hand RH on the arcuate segment 46 and his or her left hand LH on the arcuate segment 44. A left-handed user would normally place his or her right hand RH on the arcuate segment 44 and his or her left hand LH on the arcuate segment 46. Because the opposed pairs F1 and F2 of the contoured portions 29 are employed, the grip 12 readily accommodates both right-handed and left-handed users.

Figure 13:
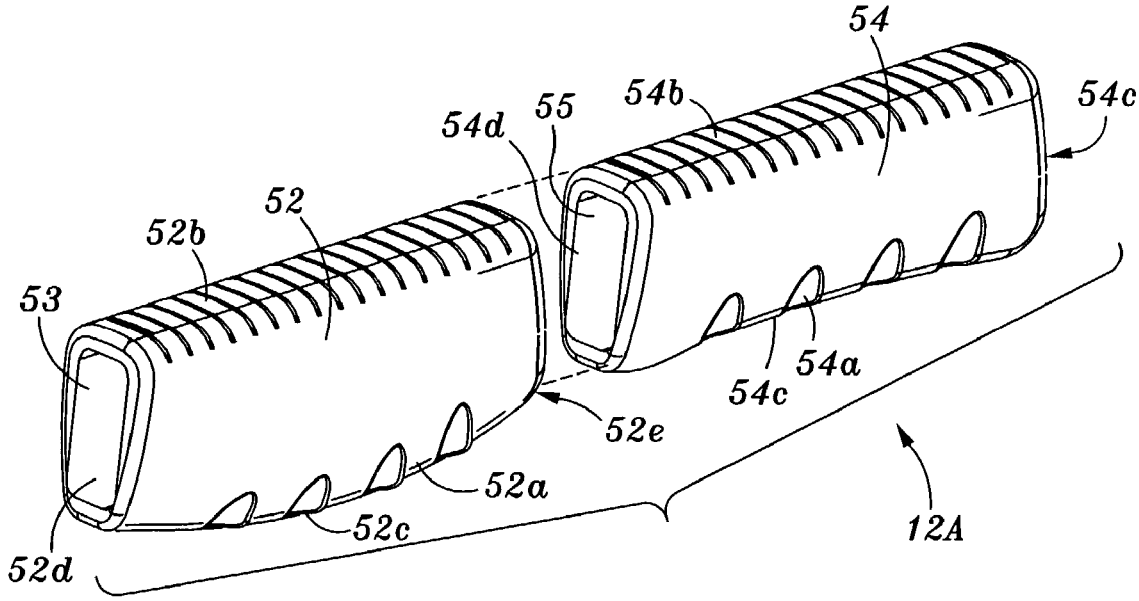
FIG. 13 is a perspective view of a cable puller grip having two bodies.

Referring to FIG. 13, in one embodiment, the grip 12A may comprise two bodies, a body 52 and a body 54. These bodies 52 and 54 are placed side-by-side along the actuating lever 20. Each body 52, 54 may have a finger section 52*a*, 54*a* and a palm section 52*b*, 54*b*. The two bodies 52, 54 may have their inner ends abut as shown in dotted lines, or their inner ends may be spaced apart as shown in solid lines. For example, their adjacent ends may be spaced apart from about 2 to about 4 inches. Each body 52, 54 may have a hollow interior 53, and 55, respectively, with the body 52 having a pair of opposed open ends 52*d* and 52*e*, and the body 54 having a closed distal end 54*e* and an open proximal end 54*d*. Each body 52, 54 may have a length from about 4 and to about 8 inches. The body 52 has a finger section 52*a* that has an arcuate segment 52*c* bowing away from the palm section 52*b*, and the body 54 has an arcuate segment 54*c* that bows toward the palm section 54*b*. The body 54 is placed outboard of the body 52 when each body 52, 54 is placed onto the actuating lever 20. A user uses the grip 12A by placing one hand on each of the bodies 52, 54.

Figure 3:
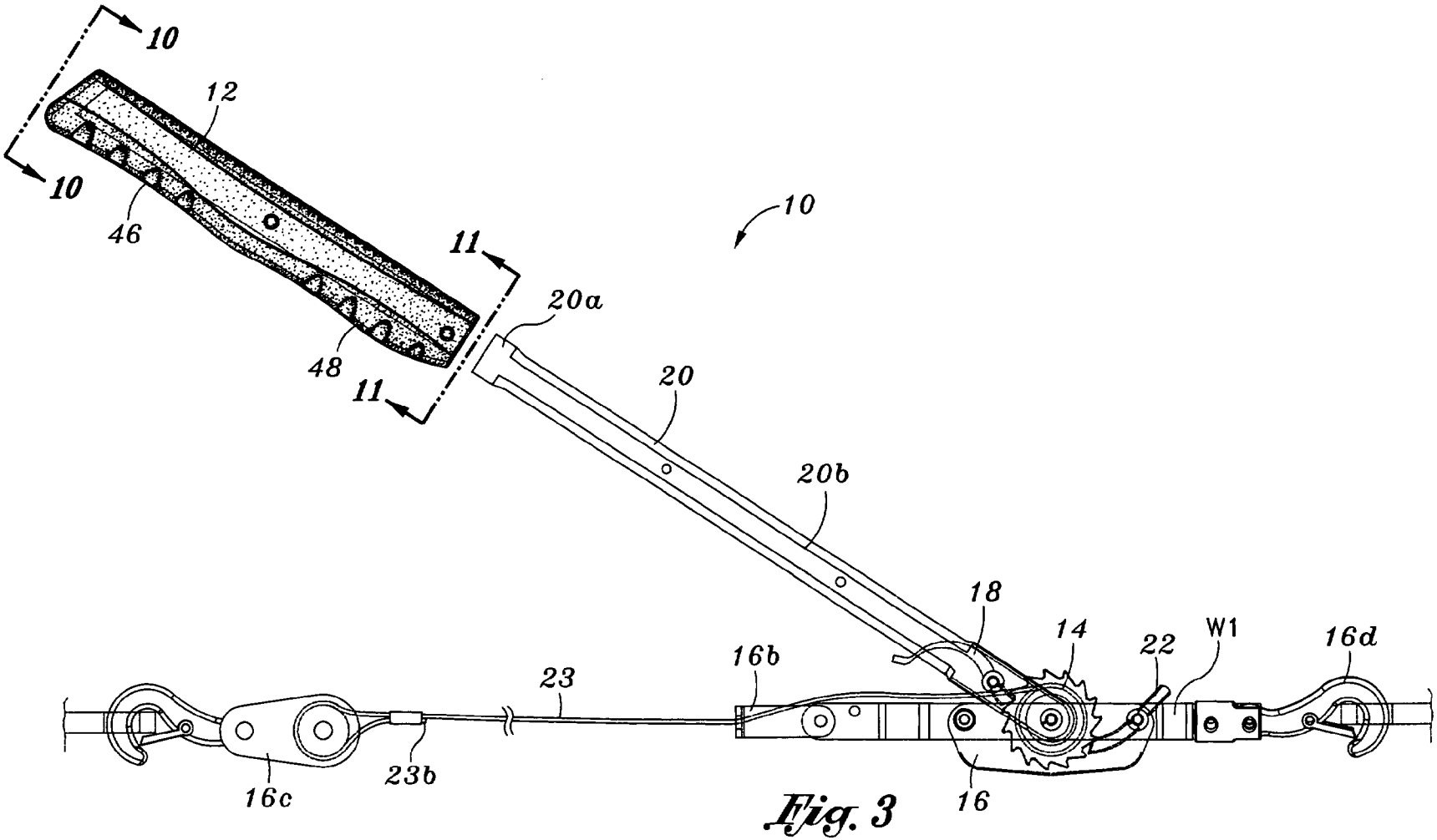
FIG. 3 is a side view of the cable puller shown in FIG. 1 with the grip exploded from the actuating lever of the cable puller.
Figure 4:
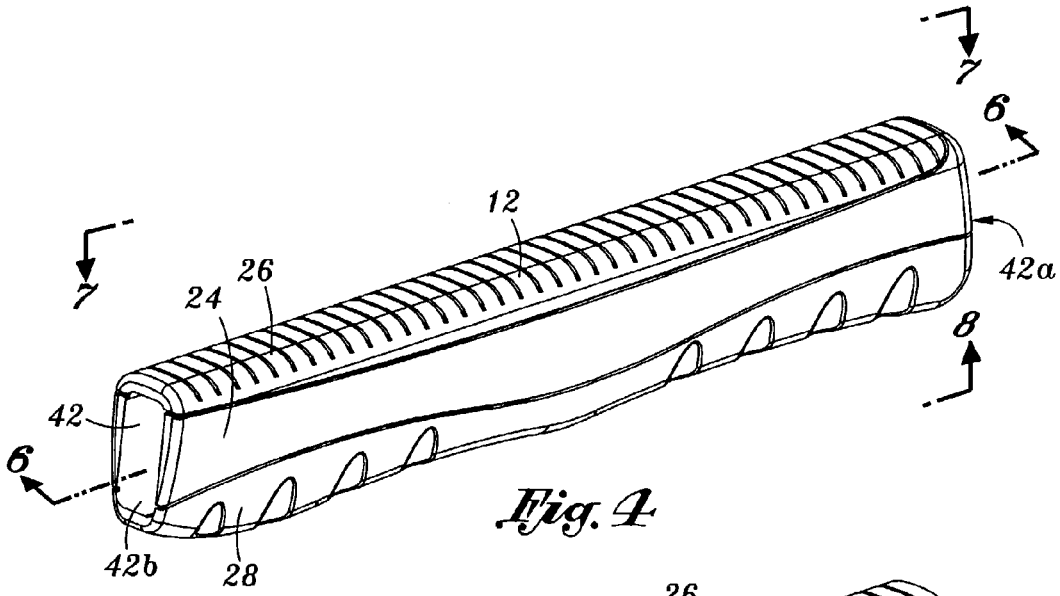
FIG. 4 is a perspective view of the cable puller grip shown in FIG. 1.

As depicted in FIGS. 1 through 3, the cable puller 10 may include drum 14 that comprises a cylinder 14*a* and a pair of ratchets 14*b* fixedly attached to opposed sides of the cylinder 14*a*. The ratchets 14*b* each have a plurality of teeth 14*c* along their respective perimeters. The frame 16, which generally may be a multi-walled structure, supports the drum 14 for rotation in both clockwise and counterclockwise directions. The frame 16 may comprise a cover 16*a* that covers the bottom of the cable puller 10. An unwinched hook 16*d* may be coupled to the frame 16*a* at one wall W1, while at another wall W2 there may be coupled a guide yoke 16*b*. The yoke 16*b* guides the movement of the cable 23 when the cable 23 is passed through it.

The actuating lever 20 may comprise a pair of legs 20*b* and 20*c* coupled together to form a single unitary lever 20. The feed pawl 18 may be a U-shaped member that is mounted to the actuating lever 20 to rotate, and is adapted to engage the teeth 14*c* of the ratchets 14*b*. The feed pawl 18 may have a pair of legs that each engage one of the individual ratchets 14*b* so as to rotate the drum 14 when the actuating lever 20 is rotated in the clockwise direction as viewed in FIG. 2. The feed pawl 18 may have a lowered, engaged position where the feed pawl 18 engages the teeth 14*c* of the ratchets 14*b*, and a raised, disengaged position where the feed pawl 18 does not engage the teeth 14*c* of the ratchets.

The retainer pawl 22 may be a U-shaped member having a pair of legs, one engaging each of the ratchets 14*b*. The retainer pawl 22 engages the ratchets 14*b* to prevent rotation of the drum 14 in a counterclockwise direction as viewed in FIG. 2, but do not prevent rotation of the drum 14 in a clockwise direction as viewed in FIG. 2. The retainer pawl 22 may be mounted on the frame 16 to pivot when manually depressed to disengage from the teeth 14*c* of the ratchets 14*b* on the drum 14.

The cable 23 may be fixedly attached at its proximal end 23*a* to the drum 14 and at its distal end 23*b* to a winched hook 16*c*. The cable 23 may be wound and unwound from the drum 14 by rotating this drum using the actuating lever 20. When attached to a load, the winding up of the cable 23 on the drum 14 causes the cable 23 to become taut and usually moves the load if it is not excessively heavy. Excessively heavy loads may results in the cable 23 breaking. A user may attach the hook 16*c* at the distal end 23*b* of the cable 23 to a load, and attach the unwinched hook 16*a* to an anchor. The cable 23 may then be wound around the drum 14 to pull the load by rotating the drum 14 in a clockwise direction as viewed in FIG. 2 by manually pulling the actuating lever 20 inward towards the drum 14. The indented portions 29 assist the user in orienting his or her hands 62*a*, 62*b* in a side-by-side relationship when grasping the grip 12 as discussed previously. By grasping the lever 20 with both hands 62*a*, 62*b* in a side by side relationship on the grip 12 as illustrated in FIG. 2, the user not only distributes the pulling force over the length of the lever 20 rather than just at its distal end 20*a*, he or she has the ability to more easily control the orientation of the cable puller 10 and twist the lever to one side or the other as he or she is manipulating the lever. The user, because of the shape of the arcuate segments 44 and 46 of the finger section 28, has a firmer, more comfortable hold on the lever 20.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A grip adapted to be coupled to a manually actuated lever of a cable puller that assists a user to hold the lever with two hands positioned side by side, said grip comprising an elongated body having a length greater than 12 inches and including a first longitudinal side and a second longitudinal side opposite said first longitudinal side, a palm section extending lengthwise substantially along the entire length of said first longitudinal side, and a finger section extending lengthwise substantially along the entire length of said second longitudinal side, said finger section having a first arcuate segment bowing away from the palm section and a second arcuate segment bowing towards the palm section, each arcuate segment including a plurality of contoured portions in a row shaped to the outline of individual fingers from a pair of human hands.

2. The grip of claim 1 where said first arcuate segment has a length from 4 to 8 inches and said second arcuate segment has a length from 4 to 8 inches.

3. The grip of claim 1 where said body has a hollow interior with a cross-sectional area from 1.5 to 3 square inches.

4. The grip of claim 1 where said palm section comprises an exterior, substantially planar surface with rounded lateral edges and having a plurality of laterally orientated grooves positioned side by side and substantially parallel to each other.

5. The grip of claim 1 where said first arcuate segment is inboard of said second arcuate segment and a raised, rounded intermediate segment is between said first and second arcuate segments.

6. The grip of claim 1 where said body includes an elongated hollow interior extending lengthwise, said interior having a closed end and an open end, said grip being adapted to be coupled to said actuating lever of said cable puller by inserting a distal end of said actuating lever into said interior.

7. The grip of claim 1 where at least a portion of said first longitudinal side comprises a substantially non-slippery material.

8. The grip of claim 7 where said substantially non-slippery material comprises a molded rubber material.

9. The grip of claim 1 where at least a portion of the second longitudinal side comprises a substantially non-slippery material.

10. The grip of claim 9 where said substantially non-slippery material comprises a molded rubber material.

11. The grip of claim 1 where said body has a substantially quadrilateral cross-sectional shape.

12. The grip of claim 11 where said body has a substantially trapezoidal cross-sectional shape.

13. The grip of claim 1 where said body has a substantially circular cross-sectional shape.

14. The grip of claim 1 where said body has a substantially oval cross-sectional shape.

15. The grip of claim 1 where said body has a substantially oblong cross-sectional shape.

16. The grip of claim 1 where said body comprises a sidewall and a top wall connected together to form at least one junction where an edge of the top wall meets an edge of said sidewall, and said palm section comprises a first segment covering at least a portion of the top wall, and a second segment overlapping said junction and covering a portion of said sidewall.

17. The grip of claim 1 where said body comprises a sidewall and a bottom wall connected together to form at least one junction where an edge of the bottom wall meets an edge of said sidewall, and said finger section comprises a first segment covering at least a portion of said bottom wall and a second segment overlapping said junction and covering a portion of said sidewall.

18. The grip of claim 1 where said palm section is bonded to said body by molding.

19. The grip of claim 18 where said palm section is bonded to said body by insert molding.

20. The grip of claim 1 where said palm section and said body are bonded by stamping.

21. The grip of claim 1 where said finger section is bonded to said body by molding.

22. The grip of claim 21 where said finger section and said body are bonded by insert molding.

23. The grip of claim 1 where said finger section and said body are bonded by stamping.

24. A cable puller comprising a lever with the grip of claim 1 mounted thereon.

25. A grip adapted to be coupled to a manually actuated lever of a cable puller that assists a user to hold the lever with two hands positioned side by side, said grip comprising an elongated body which has a hollow interior adapted to receive the lever, said body having a length from 12 to 16 inches, said body having a palm section comprising a substantially non-slippery material and a finger section opposite the palm section comprising a substantially non-slippery material, said finger section having a first arcuate segment that bows away from the palm section and having a length from 4 to 8 inches, and a second arcuate segment bowing towards the palm section and having a length from 4 to 8 inches, said first and second arcuate segments each including a plurality of contoured portions in a row shaped to the outline of individual fingers from a pair of human hands.

26. The grip of claim 25 where said palm section curves laterally, substantially to the shape of a partially closed palm of a human hand, and including an exterior, substantially planar surface with rounded lateral edges and having a plurality of laterally orientated grooves positioned side by side and substantially parallel to each other.

27. The grip of claim 25 where the body has a proximal open end and a distal closed end, and said first arcuate segment is inboard of said second arcuate segment.

28. A cable puller comprising a lever with the grip of claim 25 mounted thereon.

29. In combination a grip and a manually actuated lever of a cable puller that assists a user to hold the lever with two hands positioned side by side, comprising said grip comprising an elongated hollow body into which the lever extends, said grip having a palm section and a finger section opposite the palm section and facing away from the user upon actuating the lever, said finger section having a first arcuate segment that bows away from the palm section and a second arcuate segment bowing towards the palm section, said first arcuate segment being inboard of said second arcuate segment, said first and second arcuate segments each including a plurality of contoured portions in a row shaped to the outline of individual fingers from a pair of human hands, said contoured portions comprising eight opposed pairs in two groups of four, one group of four on each arcuate segment.

30. A cable puller comprising the combination of claim 29.

31. A grip adapted to be coupled to a manually actuated lever of a cable puller that assists a user to hold the lever with two hands positioned side by side, said grip comprising an elongated, substantially hollow body having length from 12 to 16 inches, said body comprising first and second opposed sidewalls, a top wall, and a bottom wall connected together to form a first junction where an edge of the top wall meets an upper edge of the first sidewall, a second junction where another edge of the top wall meets an upper edge of the second sidewall, a third junction where an edge of the bottom wall meets a lower edge of the first sidewall, and a fourth junction where another edge of the bottom wall meets a lower edge of the second sidewall, a palm section comprising a substantially non-slippery material including a first segment covering at least a portion of the top wall, a second segment overlapping the first junction and covering at least partially an upper portion of the first sidewall, and a third segment overlapping the second junction and covering at least partially an upper portion of the second sidewall, and a finger section comprising a substantially non-slippery material including a first segment covering at least a portion of the bottom wall, a second segment overlapping the third junction and covering at least partially a lower portion of the first sidewall, and a third segment overlapping the fourth junction and covering at least partially a lower portion of the second sidewall, said finger section having a first arcuate segment bowing away from the palm section and a second arcuate segment bowing towards the palm section, each arcuate segment including a plurality of contoured portions in a row shaped to the outline of individual fingers from a pair of human hands.

32. The grip of claim 31 where said first arcuate segment is inboard of said second arcuate segment.

33. The grip of claim 32 where said first and second arcuate segments have substantially equal lengths from 4 inches to 8 inches.

34. The grip of claim 31 where said finger section and said palm section each comprise a substantially non-slippery material.

35. A cable puller comprising a lever with the grip of claim 31 mounted thereon.

36. A grip adapted to be coupled to a manually actuated lever of a cable puller that assists a user to hold the lever with two hands positioned side by side, said grip comprising an elongated body having opposed sides, a top and a bottom, each having a predetermined width, said sides tapering inward so that the bottom has a width substantially less than the width of the top, with the bottom having a rounded bottom surface that fits comfortably into partially closed fingers of a user grasping the grip, a palm section extending lengthwise along the top, and a finger section extending lengthwise along the bottom, said finger section having a first arcuate segment bowing away from the palm section and a second arcuate segment bowing towards the palm section, said first arcuate segment being inboard of the second arcuate segment.

37. A cable puller comprising a lever with the grip of claim 36 mounted thereon.

38. A grip for use with two hands positioned side by side, said grip comprising an elongated body having a length sufficient to enable a user to hold the body with two hands positioned side by side, said body including a first longitudinal side and a second longitudinal side opposite said first longitudinal side, a palm section extending lengthwise substantially along the entire length of said first longitudinal side, and a finger section extending lengthwise substantially along the entire length of said second longitudinal side, said finger section having a first arcuate segment bowing away from the palm section and a second arcuate segment bowing towards the palm section, each arcuate segment having an edge including four contoured portions in a row shaped to the outline of individual fingers from a pair of human hands.

39. The grip of claim 38 where said first arcuate segment is inboard of said second arcuate segment.

* * * * *